United States Patent [19]

Berry

[11] 3,950,124

[45] Apr. 13, 1976

[54] BURNER IGNITOR ARRANGEMENT

[76] Inventor: Fred M. Berry, 10101 Wenona Lane, Leawood, Kans. 66206

[22] Filed: Apr. 10, 1975

[21] Appl. No.: 566,912

[52] U.S. Cl. ..... 431/254; 317/96; 431/264

[51] Int. Cl.[2] ..... F23Q 3/00

[58] Field of Search ..... 431/254, 264, 255; 317/96

[56] References Cited

UNITED STATES PATENTS

| | | | |
|---|---|---|---|
| 2,811,676 | 10/1957 | Smits | 431/254 X |
| 3,632,285 | 1/1972 | Foster | 431/264 |
| 3,718,423 | 2/1973 | Matthews | 431/264 |

*Primary Examiner*—Edward G. Favors

*Attorney, Agent, or Firm*—Fishburn, Gold & Litman

[57] ABSTRACT

A burner igniting and sustaining arrangement includes a spark plug positioned adjacent the fuel discharge and which is caused to produce a rapidly repeating ignition spark through a circuit responding to a low voltage alternating current source by feeding an ignition coil connected to the spark plug.

10 Claims, 2 Drawing Figures

BURNER IGNITOR ARRANGEMENT

This invention relates to a burner igniting and sustaining arrangement and more particularly to such an arrangement which utilizes, for safety, a low voltage power source.

The use of a spark gap is well known as a means for igniting combustible gasses. In automobiles, the common method for producing the high voltage at the spark plug is to employ a set of breaker points to supply D.C. current to the primary winding of an ignition coil, the points being timed through a mechanical connection to the rotating crank shaft of the engine. When the breaker points open, the current is interrupted suddenly and the rapidly collapsing flux in the ignition coil magnetic path induces a high voltage in the secondary winding whereupon a spark is produced. In appliances which incorporate a burner, it is known to use capacity discharge systems for the purpose, however, such systems tend to be relatively slow in operation, permitting a dangerous build-up of free gas in case of a flame-out. Also, commerical line voltage was generally used in the circuit for charging the capacitors, creating a shock hazard, especially in appliances operated under damp conditions.

This invention utilizes an automotive type ignition coil and spark plug to develop the high voltage necessary to produce the spark, but employs a unique and advantageous system for controlling the primary coil current. It differs from the more conventional systems in that the power source for the ignition coil feed circuit is relatively safe low voltage current and the time between spark producing pulses is short, being controlled by the alternating current frequency found in the usual electrical utility power sources, such as 50–60 cycles per second. The high repeat rate of the spark produces a situation where the flame is substantially continuously sustained even under conditions where it would otherwise blow out. The advantages noted are particularly desirable with certain types of appliances which are semi-portable, high capacity and used under wet and dirty conditions such as wheeled steam cleaners for trucks and the like.

The novel arrangement utilizes a circuit having a silicon transistor functioning as a fast cut-off switch to complete and interrupt a relatively high current path through the primary of an ignition coil and other transistors operating in response to feed current oscillation to supply proper control signals for the switch transistor.

The principal objects of the present invention are: to provide an efficient arrangement for producing a rapidly repeating ignition spark for a burner or similar device; to provide such an arrangement which utilizes a relatively safe low voltage alternating current source; to provide such a spark producing system wherein the spark is repeated at a rate corresponding to the frequency of a low voltage current source; to provide such a circuit arrangement which utilizes the frequency of the current source to control the repeating cut-off of primary coil current in an ignition coil; to provide such an arrangement which does not require dangerous and relatively slow capacitance discharge; and to provide such a burner igniting and sustaining system which is relatively inexpensive to produce and highly reliable and long lived in service.

Other objects and advantages of this invention will become apparent from the following description taken in connection with the accompanying drawings wherein are set forth, by way of illustration and example, certain embodiments of this invention.

Figures 1, 2:
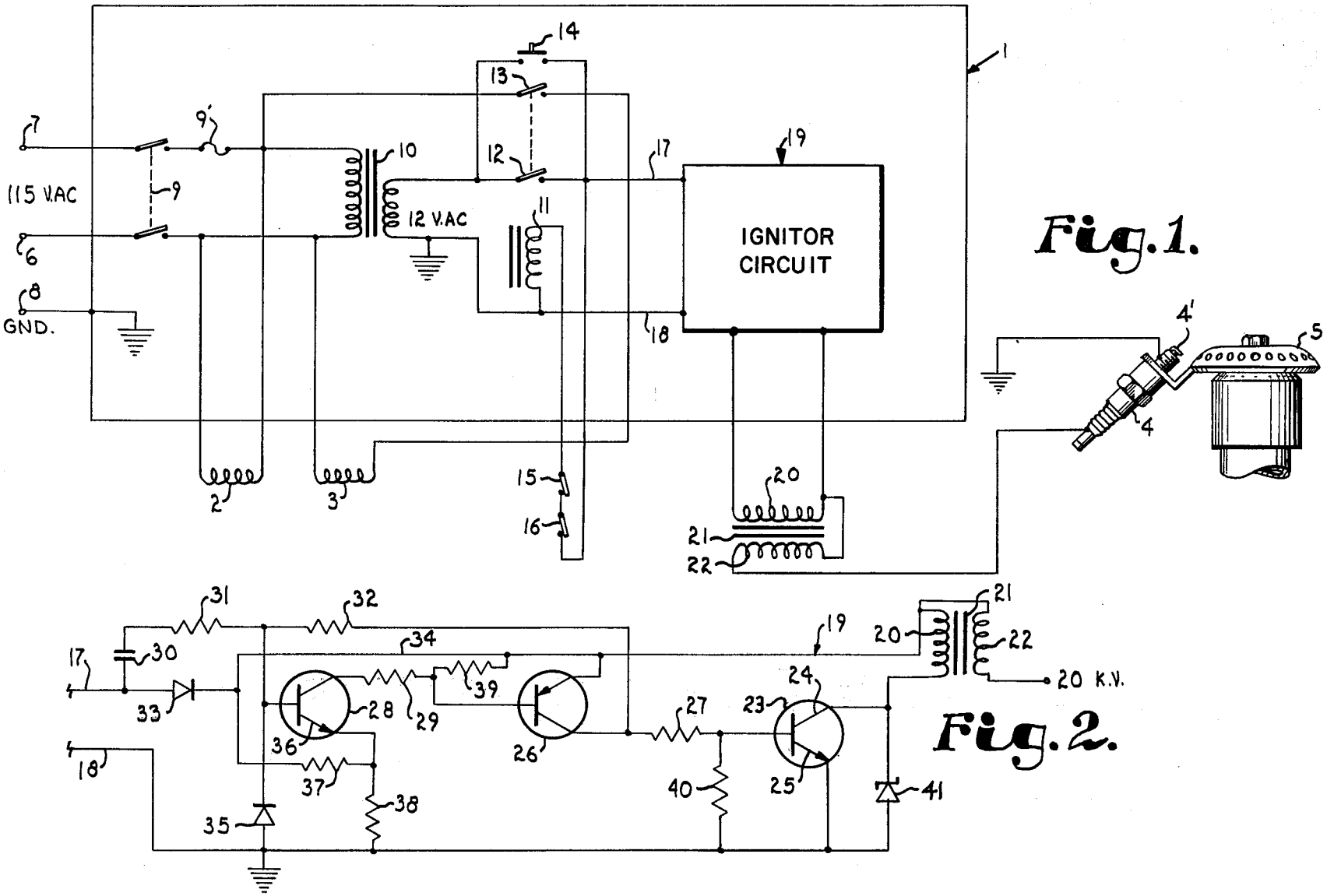
FIG. 1 is a fragmentary, partially diagrammatic view of a burner igniting and sustaining arrangement embodying this invention and integrated with controls suitable for a steam cleaner.
FIG. 2 is a diagrammatic view showing details of the ignition coil feeder circuit.

Referring to the drawings in more detail:

The reference numeral 1 generally indicates the control circuit of a steam cleaning device (not shown) including a water pump driven by a 115 volt A.C. motor having a coil 2, a gas valve solonoid coil 3 and a spark plug 4 positioned for igniting and sustaining a flame due to discharge of gas, such as butane, from a steam coil heating burner 5. The control circuit 1 is connected by suitable terminals 6 and 7 to a conventional electric power source such as 115 volts, 60 HZ and, for safety, the case is grounded at 8.

A double pole master switch 9 introduces power for the device and the overall circuit is protected by means of a suitable fuse 9'. The current from terminals 6–7 is fed through the master switch 9 to the primary of a reducing transformer 10 having an output of approximately 12 volts which is utilized for control, instead of full line voltage, to reduce the shock hazard to personnel. The lower voltage from the transformer 10 provides feeder current for a low voltage relay coil 11 which controls normally open relay contacts 12 and 13. A push button switch 14 is arranged to provide temporary excitement for the coil 11, closing contacts 12 and 13 and respectively producing actuation of the gas valve coil 3 and self-excitation of the coil 11, holding same actuated until the circuit thereto is broken.

The circuit feeding the relay coil 11 includes, in series, a thermostat switch 15 adapted to open if the steam temperature exceeds a predetermined amount, such as 300°F., and a pressure switch 16 which is normally open but closes when the water feed pressure to the device exceeds a safe amount such as from 2 to 12 psi. Upon the loss of infeed water pressure or excessive temperature the current to relay coil 11 is broken and contact 13 opens, de-energizing the coil 3 and thereby shutting off the flow of fuel gas to the burner 5. The relay coil 11 and the associated thermostat and pressure switches 15 and 16 are operated at a low, and relatively safe 12 volts.

The noted low voltage control power is also fed, by means of source line 17 and grounded line 18 to an ignitor circuit 19 shown in detail by FIG. 2. The function of the circuit 19 is to build up current in an automotive type ignition coil primary winding 20, until sufficient energy is stored in the magnetic field of the core 21, and then rapidly cut off the current, which, in turn, induces a high voltage in the secondary winding 22, causing the energy stored to be released as high voltage in the nature of 20 kilovolts. This is sufficient to produce a gas igniting spark across the gap 4' of the spark plug 4.

The ignitor circuit 19 comprises a power transistor 23, in this example, an NPN silicon type, which is used as a switch to complete the current path in the primary winding 20 of the ignition coil. The characteristics of the switching depends upon the primary winding 20 which, for the example shown, requires that the transistor 23 conduct approximately 3 amps while having 1 volt, or less, drop between the collector 24 and emitter 25. In the cut-off condition, the collector-to-emitter potential rises to 85 volts and, therefore, the breakdown voltage of transistor 23 must be greater than this minimum, for example, 90 volts. The transistor 23 should also have a high beta (collector current over base current, or current gain) thereby requiring low base current when it is in the on-condition.

Supporting control transistor 26, in this example, is a PNP, low voltage, medium power type which serves to supply driving current for turning transistor 23 on and off. When transistor 26 is on, and is saturated, transistor 23 is supplied base current through a suitable resistor 27. Transistor 26 is, in turn, driven by an NPN transistor 28 associated with a resistor 29 for limiting the base current to resistor 26. Transistor 28 is a low power, low voltage NPN type which is driven from the AC supply voltage through a capacitor 30 and resistor 31 and by feed back through resistor 32.

In the example shown, grounded line 18 is considered common to the described circuitry and line 17 is the AC source voltage. The voltage at 17 is sinusoidal at supply line frequency (50 or 60 HZ) and varies from zero to a maximum positive peak (approximately 15 volts in the example shown) then back to zero, reverses to a maximum negative peak and then back to zero. Assuming that the voltage at source line 17 is leaving zero and starting positive, when the voltage becomes an appreciable quantity, for example, 6 volts positive, a diode 33 conducts and allows voltage to start increasing in line 34. Current also flows through capacitor 30 and resistor 31 to the base of transistor 28, allowing it to turn on. When transistor 28 is on, base current is supplied to transistor 26 which also turns on and, in turn, turns on transistor 23. The voltage in line 17 continues to rise and current flows through the ignition coil winding 20 and continues to flow until the voltage in line 17 reaches its maximum at the positive peak of the AC cycle and reverses direction, starting toward zero. This reverses the direction of the current to the base of transistor 28 whereupon it starts to cut off. This, in turn, reduces the base drive to resistor 26 and it too starts to cut off.

The voltage at the collector of transistor 26, starts to fall and is coupled through resistor 32 back to the base of transistor 28. Since the base of transistor 26 was starting to go more negative, the action of the current from resistor 32 speeds up the cut-off of transistor 28. Feed-back resistor 32 thus causes regenerative action and transistors 28, 26 and 23 are rapidly forced to cut-off, thus quickly interrupting the current through primary winding 20 and including a high voltage across the secondary winding 22.

During the remainder of the positive half cycle of the AC input, transistor 28 is held at cut-off by current through capacitor 30 and resistor 31. During the negative half cycle of the AC input, diode 33 prevents voltage from appearing on line 34 and no appreciable current flows through the primary winding 20 or the transistors. Current flows in a negative direction through capacitor 30, resistor 31 and a diode 35, the latter preventing a negative voltage from being applied to the base of transistor 28 and furnishing a charging path for the capacitor 30.

Fixed bias for the emitter 36 of transistor 28 is developed by divider resistors 37 and 38. This fixed bias is required to allow transistor 28 to be held beyond cut-off by the action of the feed-back path through resistor 32.

Resistors 39 and 40 furnish a path for leakage and storage current in transistors 26 and 23 and allow them to cut-off rapidly. Zener diode 41 prevents transient voltage, developed by the primary winding 20, from destroying the transistor 23. If the transistor 23 is selected to accommodate sufficient transient voltage, the Zener diode 41 may be eliminated.

Suitable components for the various parts of the sample ignitor circuit 19 are:

| | | | |
|---|---|---|---|
| Transistor 23 | - 2N3055 | Diode 33 | - 3 amps |
| Transistor 26 | - 2N6181 | Diode 35 | - 3 amps |
| Transistor 28 | - 2N3567 | Resistor 37 | - 100 Ohms |
| Resistor 29 | - 470 Ohms | Resistor 38 | - 270 Ohms |
| Capacitor 30 | - .22mfd | Resistor 39 | - 3300 Ohms |
| Resistor 31 | - 2700 Ohms | Resistor 40 | - 100 Ohms |
| Resistor 32 | - 8200 Ohms | Zener Diode 41 | - Rated 90 volts |

It is to be understood that although certain forms of this invention have been illustrated and described, it is not to be limited thereto except insofar as such limitations are included in the following claims.

What is claimed and desired to secure by Letters Patent is:

1. Apparatus for producing a rapidly repeating ignition spark for igniting a burner forming part of a device utilizing an alternating current source, said arrangement comprising:

a. a circuit including a power transistor, an ignition coil having a primary and a secondary winding, and a spark plug, b. said primary winding being connected to said source through the collector current path of said power transistor, c. said secondary winding being connected across the gap of said spark plug, and d. a regenerative feeder connected to the base of said power transistor and accelerating cut-off upon reversal of source voltage direction, e. whereby sparks are repeatedly created across the gap of said spark plug in response to the alternating of said current source.

2. The apparatus as set forth in claim 1 wherein:

a. said current source is sufficiently low in voltage to be a minimal personnel hazard.

3. The apparatus as set forth in claim 1 wherein:

a. said current source is approximately 12 volts and 50–60 HZ.

4. The apparatus as set forth in claim 1 wherein:

a. said regenerative feeder comprises a pair of coupled transistors connected by a signal reinforcing feedback circuit.

5. The apparatus as set forth in claim 4 wherein:

a. said pair of coupled transistors comprises an NPN type and a PNP type, b. said NPN type having the base thereof connected to the collector of the PNP type through a resistor for promoting regeneration.

6. In a burner containing device having a low voltage alternating control current source, apparatus for producing a continuously repeating burner ignition spark comprising:

a. a circuit including a power transistor, a pair of coupled signal transistors fed by said source, an ignition coil having a primary and a secondary winding, and a spark plug connected across said secondary winding, b. said primary winding being connected to said source through the collector current path of said power transistor, c. said signal transistors being connected to the base of said power transistor and forming a signal cut-off regenerating circuit accelerating cut-off of said power transistor upon reversal of source voltage direction.

7. The device as set forth in claim 6 wherein:

a. said current source is in the nature of 12 volts and 50–60 HZ.

8. The structure as set forth in claim 6 wherein:

a. said device includes a gas valve solenoid, b. said spark producing apparatus being electrically associated with said solenoid for simultaneous actuation.

9. The structure as set forth in claim 6 wherein:

a. said device includes a thermostat and a pressure switch electrically associated with said spark producing apparatus upon the opening of either said pressure switch or thermostat.

10. The device as set forth in claim 6 wherein:

a. said signal transistors are interconnected through a feedback resistor.

* * * * *